United States Patent [19]

Myers

[11] 4,163,921

[45] Aug. 7, 1979

[54] INTERNALLY VANED TUBE CONSTRUCTION

[75] Inventor: Herman L. Myers, West Newton, Mass.

[73] Assignee: Raytheon Company, Lexington, Mass.

[21] Appl. No.: 859,506

[22] Filed: Dec. 9, 1977

[51] Int. Cl.[2] ..... H01J 25/50

[52] U.S. Cl. ..... 315/39.51; 29/25.14; 29/25.17; 315/39.75

[58] Field of Search ..... 315/39.51, 39.75, 39.63, 315/39.65, 39.67; 29/25.14, 25.17

[56] References Cited

U.S. PATENT DOCUMENTS

| | | | |
|---|---|---|---|
| 2,233,482 | 3/1941 | Linder | 315/39.51 X |
| 2,477,122 | 7/1949 | Garner | 315/39.75 |
| 2,548,808 | 4/1951 | Nichols | 315/39.75 |
| 2,591,976 | 4/1952 | Stinchfield | 315/39.51 X |
| 2,929,959 | 3/1960 | Dunsmuir | 315/39.75 |
| 4,041,350 | 8/1977 | Shitara et al. | 315/39.51 |

*Primary Examiner*—Saxfield Chatmon, Jr.
*Attorney, Agent, or Firm*—David M. Warren; Joseph D. Pannone; Milton D. Bartlett

[57] ABSTRACT

A procedure for the construction of an internally vaned tube for use as a magnetron anode and as a fluid conductor in a heat exchanger. A set of copper bars is passed through longitudinal slots in a mandrel to form a set of vanes and is then enclosed by counterwound silver plated copper ribbon which forms the tube. The assembly is then brazed and cut to desired length.

8 Claims, 10 Drawing Figures

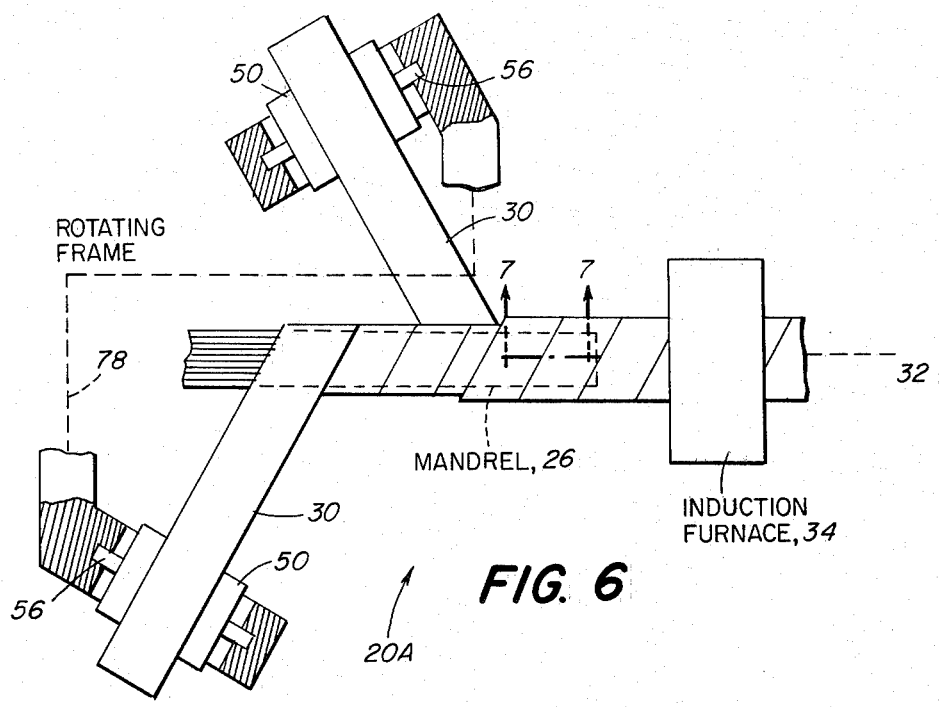
FIG. 6
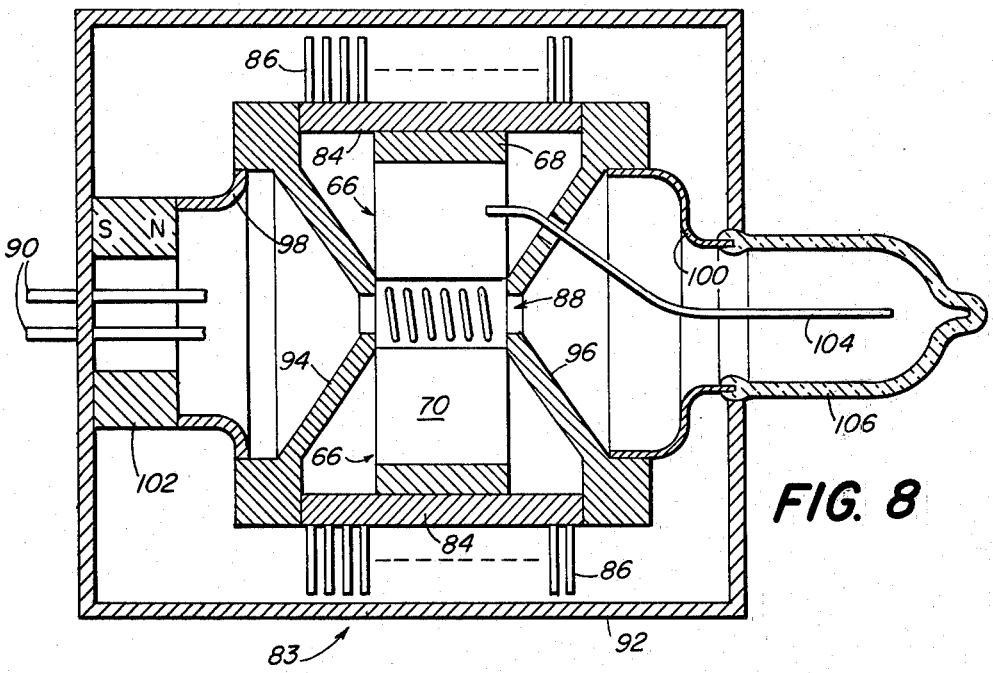
FIG. 8
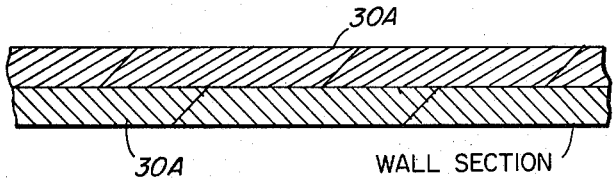
FIG. 9
FIG. 10
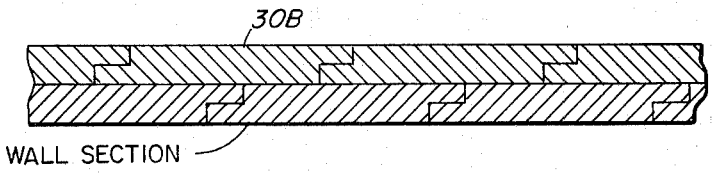

INTERNALLY VANED TUBE CONSTRUCTION

BACKGROUND OF THE INVENTION

A form of magnetron such as that disclosed in the U.S. Pat. No. 3,792,306 which issued in the name of Smith, et al. on Feb. 12, 1974 has an anode in the form of a circular cylindrical tube with radial vanes extending inwardly therefrom. A magnetron with a similarly formed anode finds extensive use today in microwave ovens. The procedure of the prior art for the manufacture of magnetrons is unduly expensive, particularly in the foregoing situation wherein large numbers of magnetrons are manufactured. The cost is also a problem when such internally vaned tubing is utilized in other situations such as a fluid conductor in a heat exchanger.

SUMMARY OF THE INVENTION

The aforementioned problem is overcome and other advantages are provided by the construction of an internally vaned tube and a magnetron incorporating such a tube by a procedure, in accordance with the invention, wherein a set of bars is passed through a set of slots on a mandrel, the slots being arranged longitudinally along an axis of the mandrel and spaced apart around the cylindrical surface of the mandrel for forming the vanes. Ribbons are then wound around the bars in the mandrel to form the walls of a tube. A chuck pulls the tube and vane assembly off the mandrel, through a furnace which brazes the ribbons and the vanes to each other, and then past a flying saw which cuts off the desired length of tube. The ribbons are of silver plated copper and the bars are also of copper in a preferred embodiment of the invention to facilitate the brazing.

BRIEF DESCRIPTION OF THE DRAWINGS

The aforementioned aspects and other features of the invention are explained in the following description taken in connection with the accompanying drawings wherein:

FIG. 6 depicts a portion of the apparatus of FIG. 1 for the case wherein a spinning frame of the apparatus has its reels angled relative to the axis of the mandrel for winding layers of ribbon to form the tube wall with the contiguous edges of the ribbon being butted together;

FIG. 8 shows a magnetron constructed with a spirally wound wall enclosing the vanes in accordance with the invention; and FIGS. 9 and 10 show alternate configurations of the ribbon for use with the apparatus of FIG. 6, the edges of the ribbon in FIG. 9 being inclined while the edges of the ribbon of FIG. 10 are stepped.

DESCRIPTION OF THE PREFERRED EMBODIMENT

Figure 1:
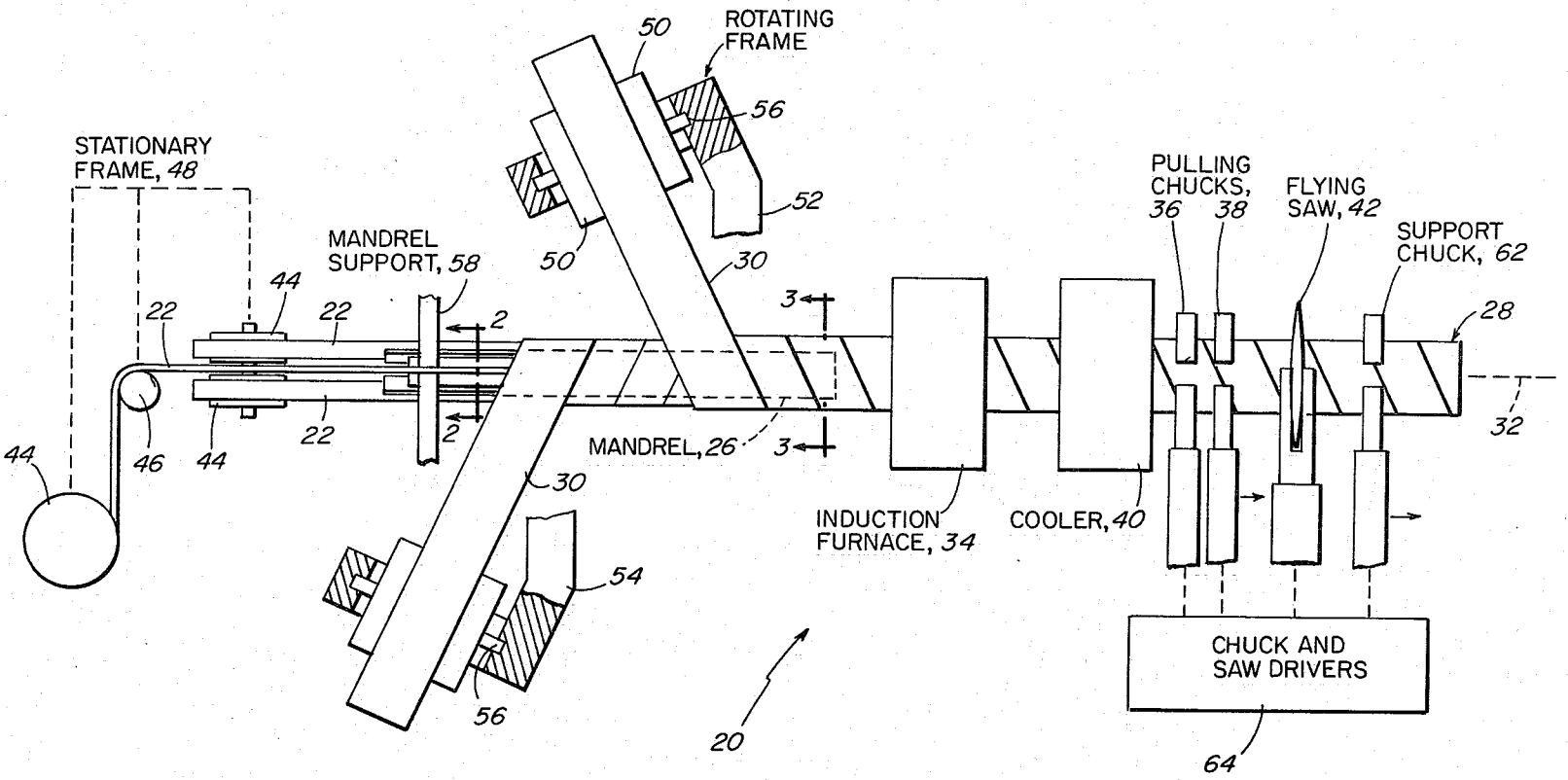
FIG. 1 shows apparatus in accordance with the invention for forming the vaned tube, the apparatus having a spinning frame producing a tube wall of overlapping spiral sections of copper ribbon.
Figure 2:
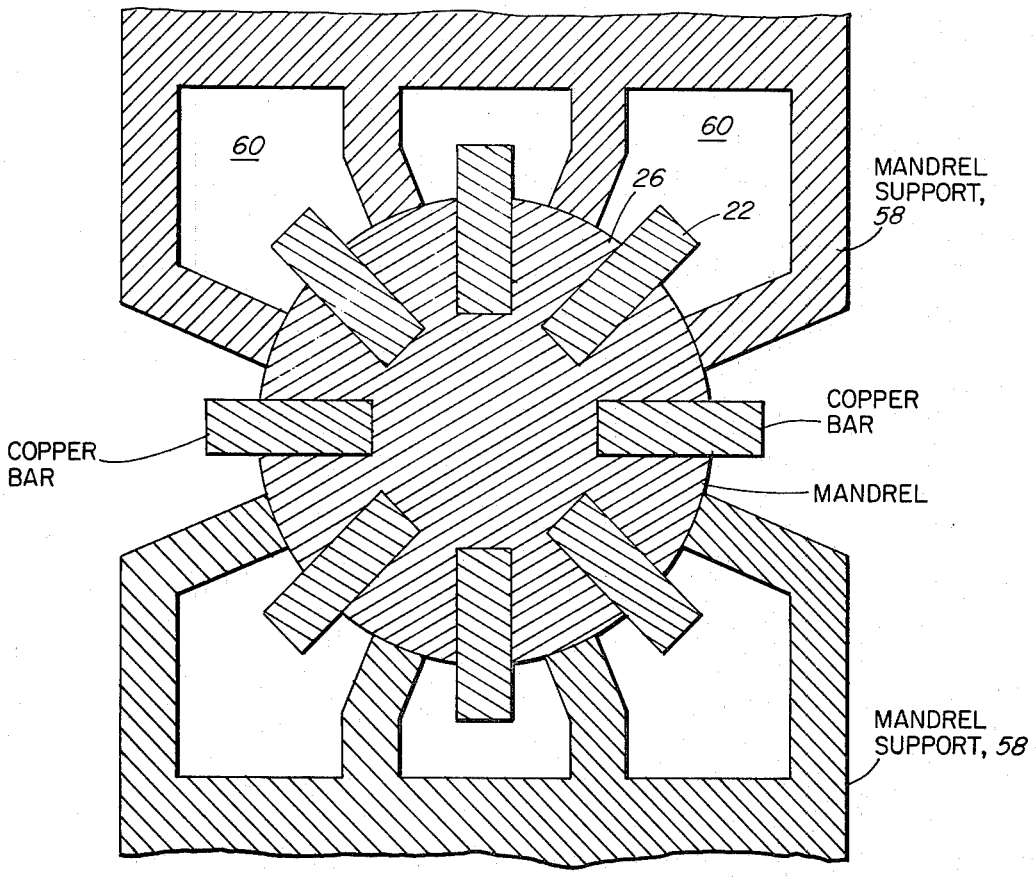
FIG. 2 is a sectional view taken along the lines 2—2 of FIG. 1 for portraying a mandrel with copper bars arranged around its periphery.

Referring now to FIGS. 1–4 there is seen an apparatus 20 for passing bars 22 through slots 24 in a mandrel 26 for forming the vanes of an internally vaned tube 28 in accordance with the invention. Ribbons 30 are spirally wound in opposite directions about an axis 32 of the mandrel 26 for forming the walls of the tube 28.

To produce an internally vaned tube for use as the anode of a magnetron, the bars 22 are fabricated from an electrically conducting material such as copper and the ribbons 30 are similarly fabricated from copper with silver plating thereon to permit the layers of the ribbons 30 to be brazed together and to be brazed to the bars 22 to form an integral assembly which is the tube 28. The brazing is accomplished in an induction furnace 34. The assembly of the ribbons 30 wound around the bars 22 is pulled by chucks 36 and 38 through the furnace 34 and then through a cooler 40 which removes the heat imparted to the assembly by the furnace 34 so that the assembly can then be cut by a flying saw 42 into predetermined lengths of tubing 28.

The bars 22 are unwound from reels 44 and, with the aid of rollers such as a roller 46, are directed in a longitudinal direction parallel to the axis 32 of the mandrel 26 for passing through the slots 24 of the mandrel 26. An even number of slots 24 is provided in the case of the magnetron with an exemplary eight slots being shown in the figures. For simplicity, only three of the eight bars 22 are shown with their associated reels 44. All eight reels 44 are supported by a stationary frame 48. By way of example, in the construction of a magnetron having a diameter of $1\frac{1}{2}$ inches and a axial length of $\frac{7}{8}$ inch, the bars 22 are typically sixty-thousandths of an inch and the ribbons 30 each have a thickness of twenty-thousandths of an inch.

The ribbons 30 are shown being fed from reels 50 which are mounted in rotating frames 52 and 54, shown partially sectioned for disclosing bearings 56 about which the reels 50 are rotated. The frames 52 and 54 carry their respective reels 50 in opposite directions around the axis 32. The reels 50 are angled relative to the axis 32 to provide for an overlapping of successive turns of the ribbon in the spiral walls produced by the winding of the ribbons 30 about the axis 32. An overlap of approximately one-quarter the width of the ribbons 30 is utilized in this embodiment of the invention.

The mandrel 26 is supported by a fixed support 58, the support 58 having apertures 60 therein through which the bars 22 are fed to the slots 24. A chuck 62 is utilized for supporting a length of tube 28 which has been cut off by the saw 42. The chucks 36, 38 and 62 and the saw 42 are positioned and driven in a conventional manner by the driver 64 which advances the chucks 36, 38 and 62 in a longitudinal direction for pulling the tube along the axis 32 while the mandrel 26 is held stationary by the support 58. In the aforementioned case wherein the bars 22 are fabricated of copper, a nonferrous metal, the mandrel 26 is fabricated of a ferrous metal such as stainless steel wherein the surface has an oxide of nickel and chromium which permits the copper bars 22 to slide through the slots 24 without binding. The chucks 36 and 38 are activated by the driver 64 to alternately grip the tube 28 in the manner of a pair of hands for drawing the assembly of ribbons 30 and bars 22 along the axis 32, the saw 42 being similarly advanced in successive passes along the axis 32 and, further being moved by the driver 64 in a transverse direction for cutting off a length of tubing 28. The chuck 62 also advances in a set of passes along the axis 32 for successively grabbing the sections of tubing 28 and for setting them aside after they have been cut by the saw 42.

Figure 5:
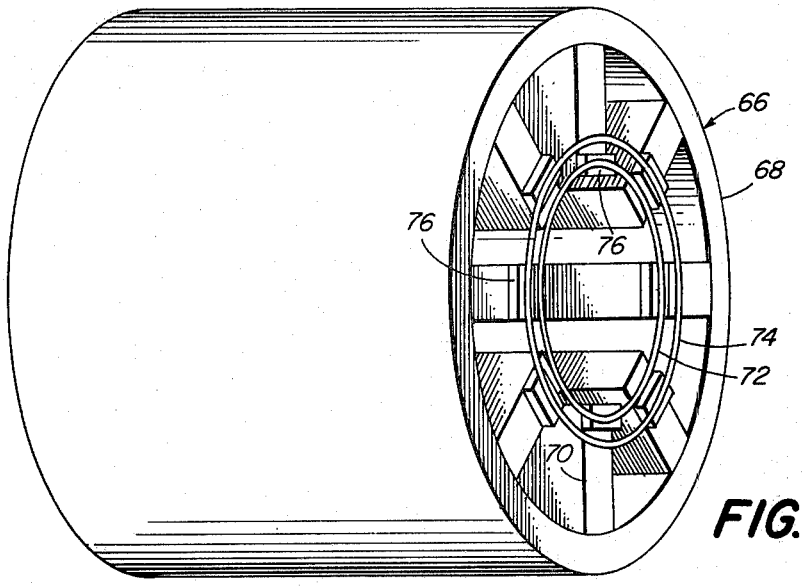
FIG. 5 shows an isometric view of an internally vaned tube produced by the apparatus of FIG. 1 and having strapping rings on the vanes for forming a magnetron anode in accordance with the invention.

Referring now to FIG. 5, there is seen a magnetron anode 66 comprising a tubular wall 68 with interior vanes 70 directed radially inward from the wall 68, and a pair of strapping rings 72 and 74 having feet 76 spaced apart circumferentially around the respective rings 72 and 74 for contacting alternate ones of the vanes 70. The assembly of the wall 68 with the set of vanes 70 attached thereto corresponds to the internally vaned tube 28 produced by the apparatus 20 of FIG. 1. Thereby, it is seen that a magnetron anode, such as the anode 66, may be fabricated by securing strapping rings, such as the rings 72 and 74, to the vanes of a predetermined length of tubing 28. The rings 72 and 74 are secured, in the preferred embodiment of the invention, by brazing.

Figure 7:
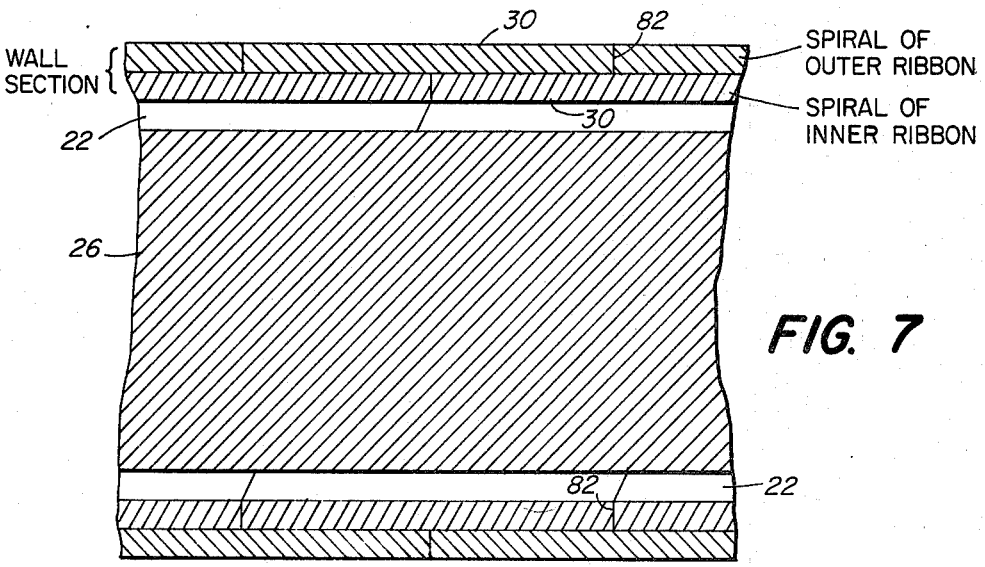
FIG. 7 is a longitudinal sectional view of a portion of the mandrel in FIG. 6 showing a double wall, end-butted ribbon construction formed by the apparatus of FIG. 6.

Referring now to FIGS. 6 and 7, there is shown a portion of an alternative embodiment of the apparatus 20 of FIG. 1, this alternative embodiment being identified by the legend 20A. The apparatus 20A differs from the apparatus 20 in that the pair of reels 50 are secured to a single frame 78 for rotating the two reels 50 in a common direction around the axis 32. A portion of the frame 78 is shown in a sectional view to disclose the bearings 56 seen also in FIG. 1. The system 20A provides for a spirally wound tubing wall wherein each turn of the ribbon 30 is butted against the previous turn of the ribbon 30, this being in contradistinction to the teaching of FIGS. 1 and 3 which show an overlapping of a turn of the ribbon 30 with a preceeding turn of the ribbon 30. Each turn of the inner ribbon lies flat against the bars 22 and in side-by-side position, as seen in the sectional view of FIG. 7, without any void such as the voids 80 of FIG. 3. Similarly, the spiral of the outer ribbon 30 lies flat against the outer surface of the inner ribbon 30 with the successive turns being positioned side by side without any of the voids 80 of FIG. 3. The reel 50 of FIG. 6 are positioned for feeding the ribbons 30 such that a turn of the outer ribbon 30 overlaps the butt joint between two turns of the inner ribbon 30. The butt joints, such as a joint 82, are silvered as well as the inner and outer surfaces of each of the ribbons 30 so that all these interfaces are brazed together by the heat of the furnace 34. Thereby, there is formed a tubular wall which, in the case of a magnetron anode, provides a secure vacuum within the magnetron and resists penetration of the atmosphere into the vacuum.

Figure 3:
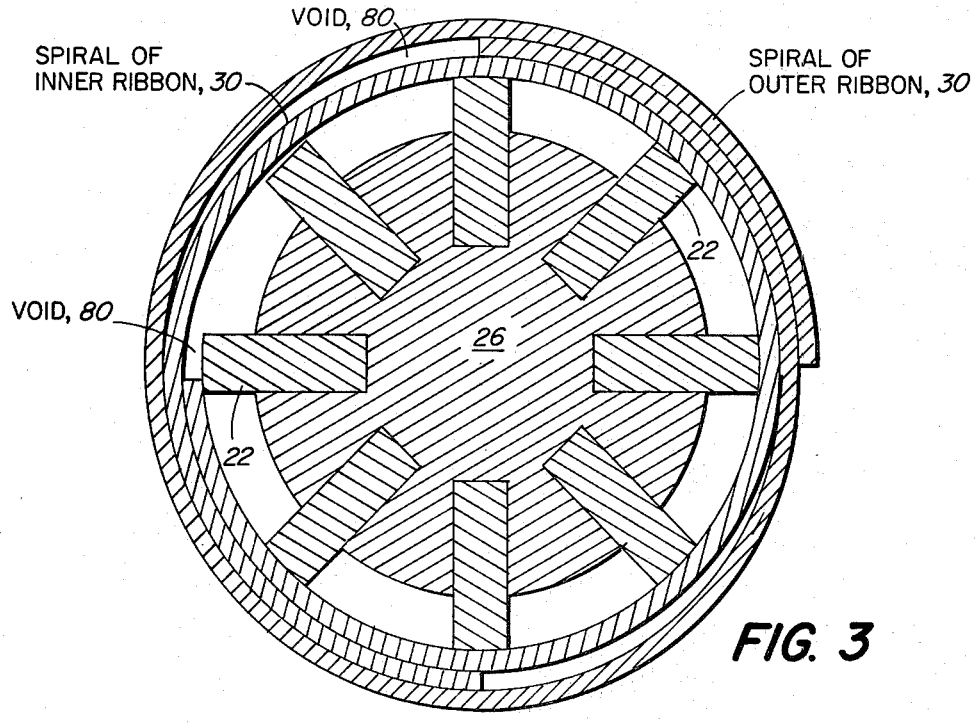
FIG. 3 is a sectional view taken along the line 3—3 of FIG. 1 for portraying a spirally wound wall of a tube enclosing the vanes of the mandrel.
Figure 4:
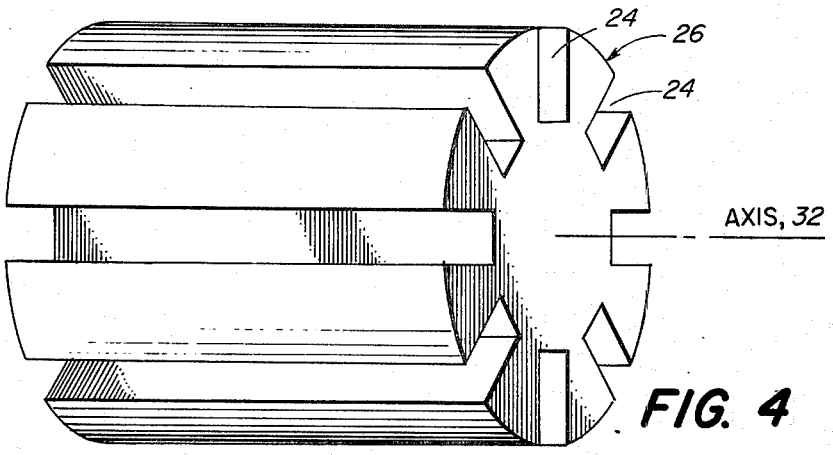
FIG. 4 is an isometric view of a mandrel of FIG. 1.

Referring now to FIG. 8, there is seen a simplified portrayal of a magnetron, similar to that shown in FIG. 1 of the aforementioned Smith patent, and comprising the anode 66 of FIG. 5. It is noted that the wall 68 of the anode 66 may be formed by the overlapping turns of ribbon 30 as shown in FIGS. 1 and 3 or by the butt joint arrangement of the turns of ribbon 30 as shown in FIGS. 6 and 7. The anode 66 is secured within an outer copper ring 84 having cooling fins 86 attached thereto whereby heat is withdrawn from the anode 66. A cathode and heater assembly 88 is positioned along the axis of the anode and is secured by wires (not shown) to leads 90 seen passing through a case 92 which encloses the magnetron 83. Magnetic pole pieces 94 and 96 are secured to the ends of the copper ring 84 and direct a magnetic field along the axis of the anode 66. Collars 98 and 100 secure the pole pieces 94 and 96 respectively to a ring shaped magnet 102 and to the forward end of the case 92, the back end of the magnet 102 being secured to the back end of the case 92. The case 92 and the collars 98 and 100 are constructed of a ferrous material such as iron for completing the magnetic circuit between the magnet 102 and the pole pieces 94 and 96. An antenna 104 conducts electromagnetic radiation from the region within the anode 66 to a region within a dielectric dome 106 from which it is coupled to a utilization device such as a waveguide for a microwave oven.

Referring now to FIGS. 9 and 10, there are shown alternative embodiments of the outer wall of the tube 28 of FIG. 1, these embodiments utilizing butt joints which differ from that of FIG. 7 in that the butt joints of FIGS. 9 and 10 are formed by an inclined ribbon edge in FIG. 9 and by a stepped ribbon edge in FIG. 10. The ribbon in FIG. 9 is identified by the legend 30A and the ribbon in FIG. 10 is identified by the legend 30B to distinguish these ribbons from the ribbons 30 referred to in FIGS. 1 and 6. The construction of the tube walls of FIGS. 9 and 10 is accomplished by the apparatus 20A of FIG. 6 wherein the ribbon 30A and 30B is applied by the reels 50. The embodiments of FIGS. 9 and 10 permit a slight reduction in the tolerances of the axial movement of the ribbon and vanes along the mandrel of FIG. 6.

It is understood that the above-described embodiments of the invention is illustrative only and that modifications thereof may occur to those skilled in the art. Accordingly, it is desired that this invention is not to be limited to the embodiments disclosed herein but is to be limited only as defined by the appended claims.

What is claimed is:

1. A method for forming a tubular structure comprising the steps of:
   - passing bar shaped material through a slot of a slotted mandrel, said material extending outwardly beyond said mandrel exposing a portion of said material;
   - passing a ribbon spirally around said mandrel and said material and contacting said exposed portion of said material;
   - separating said material from said mandrel; and
   - fusing together said ribbon and said material to form said tubular structure.

2. A method according to claim 1 wherein said material and said ribbon are made of metal and wherein said fusing is accomplished by brazing.

3. A method according to claim 1 wherein said spiral passing of said ribbon includes an overlapping of one turn of said ribbon by a second turn of said ribbon.

4. A method according to claim 1 wherein said spiral passing of said ribbon includes a butting of one turn of said ribbon by a second turn of said ribbon.

5. A method according to claim 4 further comprising a winding of a second ribbon about the aforementioned first ribbon, said winding of said second ribbon including the overlapping of a butt joint of said first ribbon by a turn of said second ribbon.

6. A magnetron comprising an anode having a spirally wound wall thereof and a set of vanes contacting said wall, said wall comprising a spiralling element, successive turns of said spiralling element of said wall contacting each other along a spiralling interface between successive turns.

7. A magnetron according to claim 6 further comprising a strapping ring fused to alternate vanes of said set of vanes of said anode, said vanes being fused to said spirally wound wall.

8. In the manufacture of a magnetron anode, a method for forming a tubular structure with inwardly directed projections comprising the steps of:

providing a mandrel of cylindrical shape with an even number of inwardly directed slots uniformly positioned about the cylindrical surface of said mandrel;

passing bar shaped material through the slots of said mandrel, said material extending outwardly beyond said mandrel exposing a portion of said material;

passing a ribbon spirally around said mandrel and said material and contacting said exposed portion of said material;

separating said material from said mandrel; and fusing together said ribbon and said material to form said tubular structure with said inwardly projecting members.

* * * * *